US006511382B1

(12) United States Patent
Ochi

(10) Patent No.: US 6,511,382 B1
(45) Date of Patent: Jan. 28, 2003

(54) FACILITY FOR PLAYING

(75) Inventor: Yasushi Ochi, Osaka (JP)

(73) Assignee: Oriental Sangyo, Ltd., Osaka (JP)

( * ) Notice: Subject to any disclaimer, the term of this patent is extended or adjusted under 35 U.S.C. 154(b) by 0 days.

(21) Appl. No.: 09/700,191

(22) PCT Filed: May 13, 1999

(86) PCT No.: PCT/JP99/02513

§ 371 (c)(1),
(2), (4) Date: Nov. 13, 2000

(87) PCT Pub. No.: WO99/59690

PCT Pub. Date: Nov. 25, 1999

(30) Foreign Application Priority Data

May 18, 1998 (JP) ..... 10-134769
Sep. 7, 1998 (JP) ..... 10-252172

(51) Int. Cl.[7] ..... A63G 31/00
(52) U.S. Cl. ..... 472/134; 472/68
(58) Field of Search ..... 472/134, 136, 472/137, 68; 273/129 AP, 457, 458

(56) References Cited

U.S. PATENT DOCUMENTS 3,643,941 A * 2/1972 Kashar ..... 472/134

FOREIGN PATENT DOCUMENTS

JP 08-126769 5/1996
JP 09-327540 12/1997

* cited by examiner

*Primary Examiner*—Kien T. Nguyen
(74) *Attorney, Agent, or Firm*—Armstrong, Westerman & Hattori, LLP

(57) ABSTRACT

The present invention relates to a facility for playing which comprises a plurality of balloons (4) retained in a space defined by a partition member (2), and at least one air supply device (7) for causing air to flow within the space, wherein the partition member (2) is constituted by an air permeable member and/or an air impermeable member, wherein the air supply device (7) is provided adjacent the bottom of the space inside and/or outside the space. The air permeable member constitutes at least a portion of the partition member (2) located adjacent the air supply device (7) provided outside the space as opposed thereto. The air impermeable member constitutes a portion of the partition member (2) located in a spaced and opposed relation to the air supply device (7), or provided downstream of the air supply device (7). The air stream supplied from the air supply device (7) is deflected by the air impermeable member opposed to the air supply device (7) to flow upward, so that the balloons (4) retained in the space are stirred by the air stream from the air supply device (7) and the upward air stream thereby to float and swirl.

8 Claims, 13 Drawing Sheets

I
5
4
A
II
2
6
1
II
3
16
15
11
7
I

FACILITY FOR PLAYING

TECHNICAL FIELD

The present invention relates to a facility for playing (an amusement system) which is advantageously installed in a resort or amusement place such as an amusement park or an ordinary park, a department store or a shopping center where infants are likely to gather.

BACKGROUND ART

As well known, various amusement systems for pleasure are installed in amusement parks and the like. For example, there are known amusement systems which comprise a horizontal rotary shaft, arms fixed to the shaft and a seat fixed to the arms, whereby the seat is rotated or pivoted about the rotary shaft within a vertical plane. With these systems, a player on the seat bodily senses the gravity (G) during ascent and the zero gravity during descent. That is, the player can easily get a special bodily sensation that cannot be experienced in daily life. These amusement systems have gained great popularity among people, particularly among adolescents.

Roller coasters are also well known as amusement rides which cause riders to feel speeds and thrills. In recent years, amusement rides have been proposed which are provided with a loop portion and a sudden reverse portion for enhancement of the feeling of speeds and thrills. These amusement systems, which also give riders a special bodily sensation that cannot be experienced in daily life, have gained great popularity among people, particularly among adolescents.

However, the aforesaid amusement systems have been developed mainly for adolescents who have a sufficient physical strength, and a limited number of amusement systems have been developed for infants who are younger generation than the adolescents.

In this respect, the inventor of the present invention proposed an amusement system mainly for infants as disclosed in Japanese Unexamined Patent Publication No. 8-126769 (1996). The amusement system includes four support posts standing upright, a partition member of a mesh material stretched between the support posts, a cover sheet provided along a hem of the partition member, balloons retained in a space defined by the partition member, and air supply devices mounted on upper ends of the respective support posts.

In this amusement system, air streams generated by the air supply devices flow from the top toward the bottom of the space. The air streams are deflected by the bottom of the space and the cover sheet, and then flow back inwardly of the space to form spiral air streams. The balloons retained in the space are stirred by the spiral air streams thereby to float and swirl. Infant players play in various ways within the space in which the balloons are thus floating and swirling.

Although this amusement system gives pleasure with an unprecedented amusement to the infants, the amusement system needs to be improved in the following aspects.

Where the balloons are charged with a gas such as helium having a lower specific gravity, the balloons are a readily stirred by the air streams flowing from the top toward the bottom of the space. More specifically, the balloons are carried downward by the air streams and then upward in the space because of their specific gravity and, again, carried downward by the air streams. Thus, the balloons easily float and swirl. Where the balloons are charged with air, on the other hand, the balloons sink on the bottom of the space in a windless state because of their specific gravity. Therefore, upward air streams flowing upward within the space should be generated to cause the balloons to float and swirl.

However, the amusement system is adapted to cause the air streams to flow from the top toward the bottom of the space so that the air streams after hitting against the bottom of the space flow along the bottom. This disadvantageously makes it difficult to generate upward air streams which flow upward in the space. Therefore, the plurality of air supply devices are provided at the top of the space in the amusement system to cause the air streams from the air supply devices to hit against the bottom of the space for generation of the upward air streams flowing toward the top of the space. However, the upward air streams have lower speeds because the air streams having hit against the bottom of the space collide with each other to form the upward air streams.

Since the air supply devices are mounted on the upper ends of the support posts in the amusement system, the support posts should have a sufficiently high strength to stably support the air supply devices, and should firmly be fixed on a floor to stably maintain their upright posture. Therefore, the support posts are heavy and, hence, difficult to transport. Further, assembling of the system requires much time and the assembling operation is not easy.

The amusement system is intended mainly for infants. Therefore, such amusement systems may be installed not only in amusement parks and ordinary parks but also in department stores and shopping centers where infants are likely to gather. Where the amusement system is installed in a department store or a shopping center, the amusement system may be used for an extended period or in an event site for a limited period. In this respect, it is preferred that the amusement system can easily be transported and easily and conveniently be assembled. Therefore, the prior art amusement system needs to be improved for ease of transportation and assembling thereof.

As a result of intensive studies conducted to further improve the prior art amusement system, the inventor has achieved the present invention. It is an object of the present invention to provide an amusement system which is capable of easily generating an upward air stream and is easy to transport and convenient to assemble.

DISCLOSURE OF THE INVENTION

In accordance with the present invention, there is provided a facility for playing (an amusement system) which comprises a plurality of balloons retained in a space defined by a partition member, and at least one air supply means for causing air to flow within the space, wherein the partition member is constituted by an air permeable member and/or an air impermeable member, wherein the air supply means is provided adjacent the bottom of the space inside and/or outside the space, wherein the air permeable member constitutes at least a portion of the partition member adjacent the air supply means provided outside the space as opposed thereto, whereby the air supply means generates an air stream which flows along the bottom of the space so that the balloons retained in the space are stirred by the air stream generated by the air supply means thereby to float and swirl.

When the air supply means is driven, an air stream of a predetermined speed is supplied from the air supply means. Since the air permeable member of the partition member is located adjacent the air supply means as opposed thereto, the air stream supplied from the air supply means provided outside the space passes through the air permeable member into the space to flow along the bottom of the space (along a floor surface) On the other hand, the air stream from the air supply means provided inside the space directly flows along the bottom of the space.

Where the air impermeable member of the partition member is located in a spaced and opposed relation to the air supply means or located downstream of the air supply means, the air stream flowing along the bottom of the space hits against the air impermeable member to be deflected, and flow along the air impermeable member.

Where the air impermeable member is provided perpendicularly to the bottom of the space, the air stream supplied from the air supply means is deflected by the air impermeable member to flow along the air impermeable member, i.e., deflected into an upward air stream flowing upward in the space.

In accordance with the present invention, the upward air stream is easily generated within the space. Further, the air stream flowing along the bottom of the space once hits against the air impermeable member to be deflected into the upward air stream. Therefore, reduction in the kinetic energy of the air stream is suppressed, so that the speed of the upward air stream can properly be maintained. Even if the balloons retained in the space have such a high specific gravity that the balloons sink on the bottom of the space in a windless state, the balloons can easily be stirred thereby to float and swirl. That is, the balloons present adjacent the bottom of the space is moved upward in the space by the air stream flowing along the bottom of the space and the upward air stream flowing along the air impermeable member. Finally, the balloons naturally sink onto the bottom of the space by gravity. This process sequence is repeated, whereby the balloons float and swirl.

Players play in various ways within the space in which the balloons are thus floating and swirling. For example, infant players play tag with their sight being obstructed by the balloons. Adult players walk into the space through an entrance to look for an exit thereby to enjoy feeling as if they were in a labyrinth. Further, players simply enjoy catching the floating balloons.

Since-the air supply means is provided adjacent the bottom of the space, the provision of the air supply means is easily achieved with a relatively simple construction. Therefore, the amusement system according to the present invention is easy to transport and easy and convenient to assemble.

The air permeable member herein means a member that permits air (gas) to pass therethrough from one side to the other side thereof with sufficient vigor, and examples thereof include a mesh member and a grid member. More specifically, the air permeable member may be composed, for example, of a mesh material or a grid material of natural fibers such as of a resin (e.g., rubber) or a metal, synthetic fibers, glass filaments or metal filaments, or composed of a mesh material or a grid material of ropes or belts of any of these fibers and filaments. The air impermeable member is capable of limiting air passage to some extent, and may be a plate such as a glass plate, an acryl plate or a wood plate, a resin sheet such as a nylon sheet or a vinyl sheet, a woven or knitted fabric, or a structure such as of concrete.

The air supply means to be employed in the present invention may include at least one pair of air supply means which are disposed in such a relation that air supply directions thereof are crosswise to each other. With this arrangement, the air streams supplied from the respective air supply means flow along the bottom of the space and collide with each other within the space, so that turbulence (swirl) including an upward air stream flowing upward in the space is generated. The balloons retained in the space are stirred by the air streams from the air supply means and the turbulence thereby to float and swirl. Therefore, the air streams collide with each other with a smaller energy loss than in a case where the air streams hit against other members before colliding with each other. Thus, the speed of the turbulence after the collision is properly maintained, so that the balloons in the space float and vigorously swirl.

The air supply means may include an air supply mechanism for supplying energized gas in a predetermined direction, and a housing accommodating therein the air supply mechanism and having an air inlet and an air outlet. This arrangement is preferred because the players and the like can step onto the housing. More specifically, where the air supply means is located adjacent the bottom of the space outside the space, observers of infant players can observe or keep watch on the infant players who are playing in the space from the outside while sitting on the housing without physical fatigue. Where the air supply means is located adjacent the bottom of the space inside the space, the infants (players) can enjoy stepping on and off the housing with increasing pleasure.

The air outlet may be provided with louvers for changing the flow direction of the air stream supplied from the air supply mechanism. Thus, the air flow direction in the space can be adjusted by the louvers, whereby the floating state of the balloons in the space can be optimized. The louvers may be adapted to be driven by driver means, so that the air flow direction within the space can automatically be changed. Thus, the air flow direction can be varied every moment, whereby the floating state of the balloons can be varied.

BEST MODE FOR CARRYING OUT THE INVENTION

The amusement system (the facility for playing) according to the present invention will hereinafter be described in detail with reference to the attached drawings.

Figure 1:
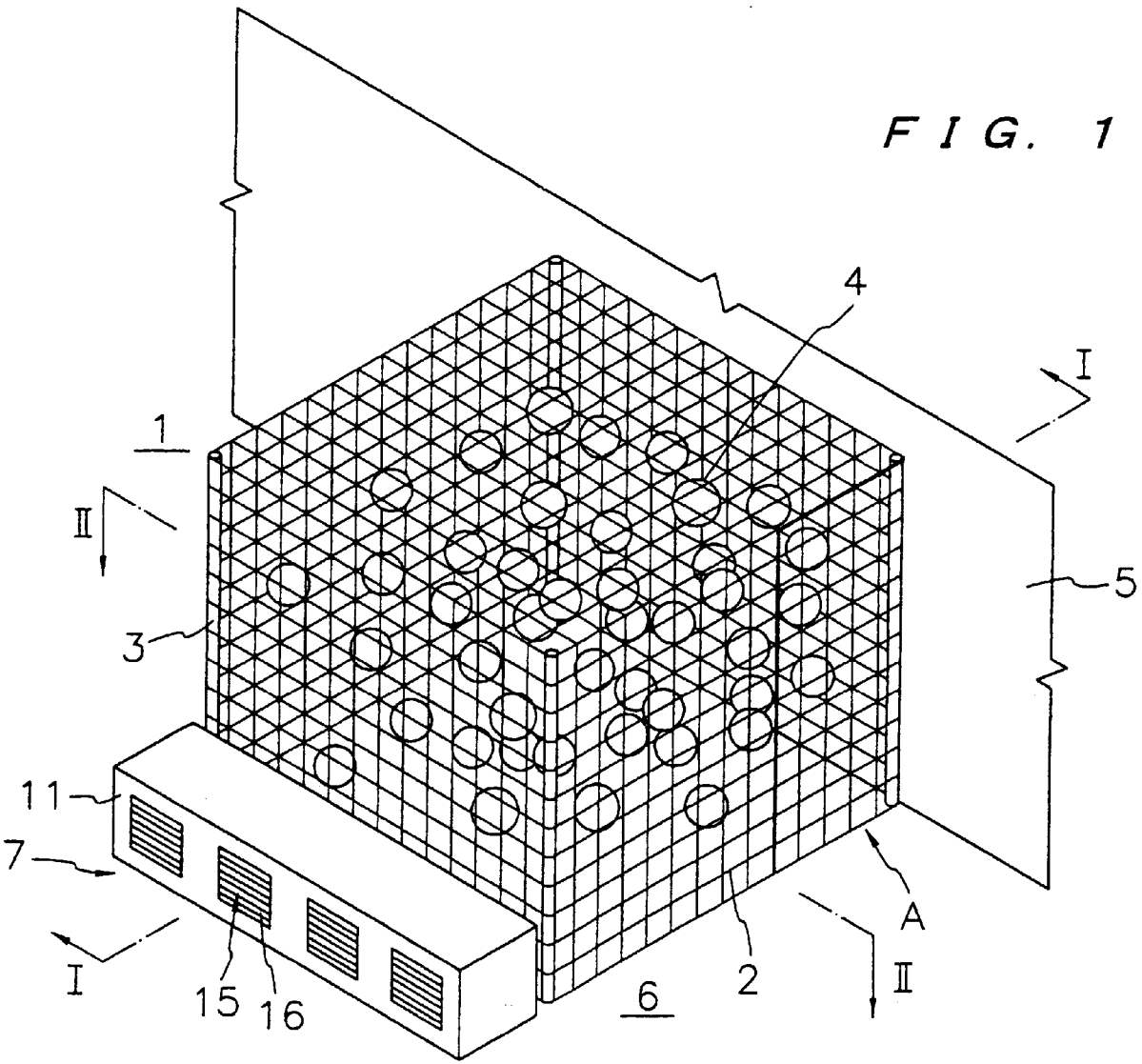
FIG. 1 is a perspective view illustrating an amusement system according to a preferred embodiment of the present invention.
Figure 2:
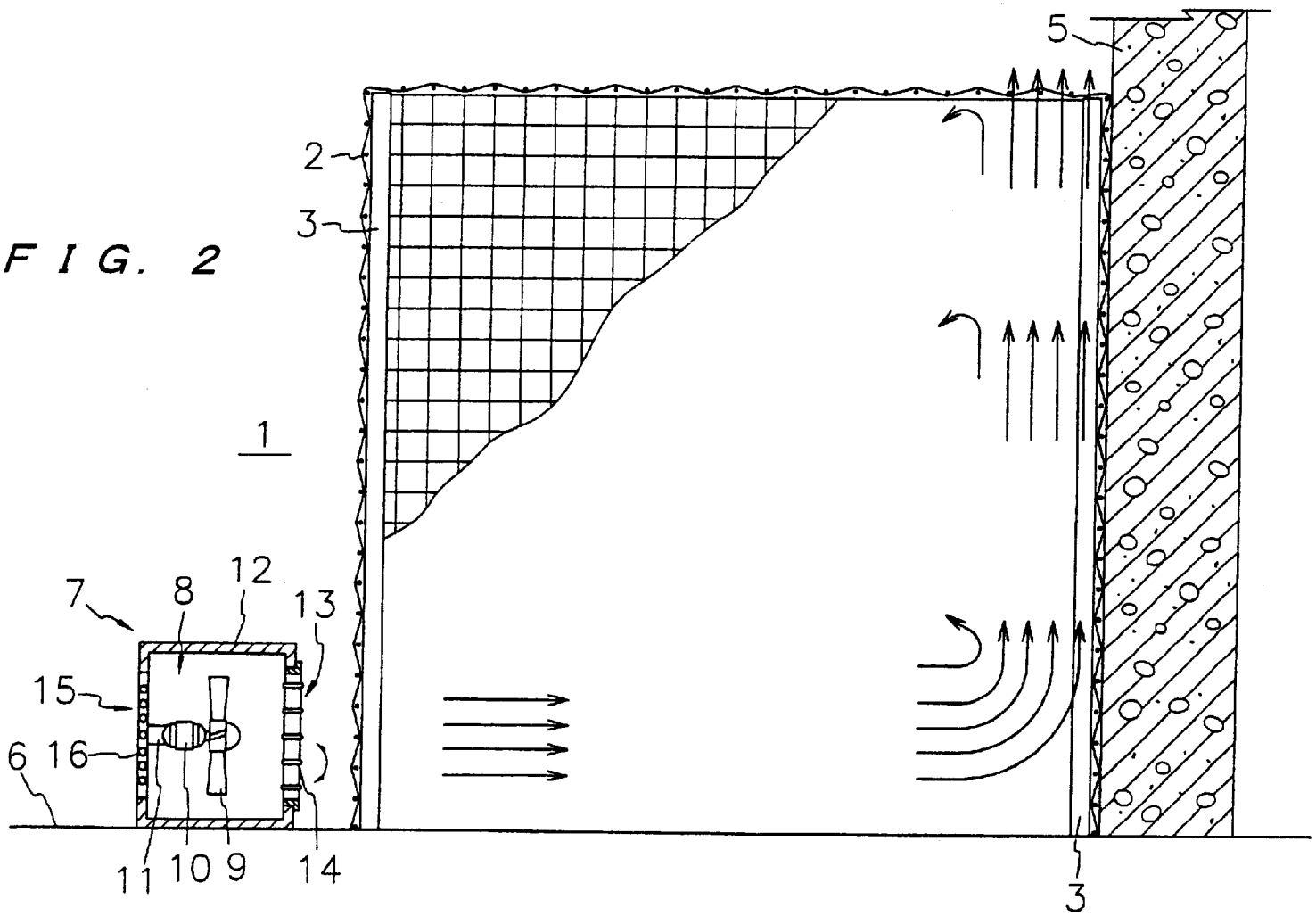
FIG. 2 is a sectional view as seen in an arrow direction I—I in FIG. 1.
Figure 3:
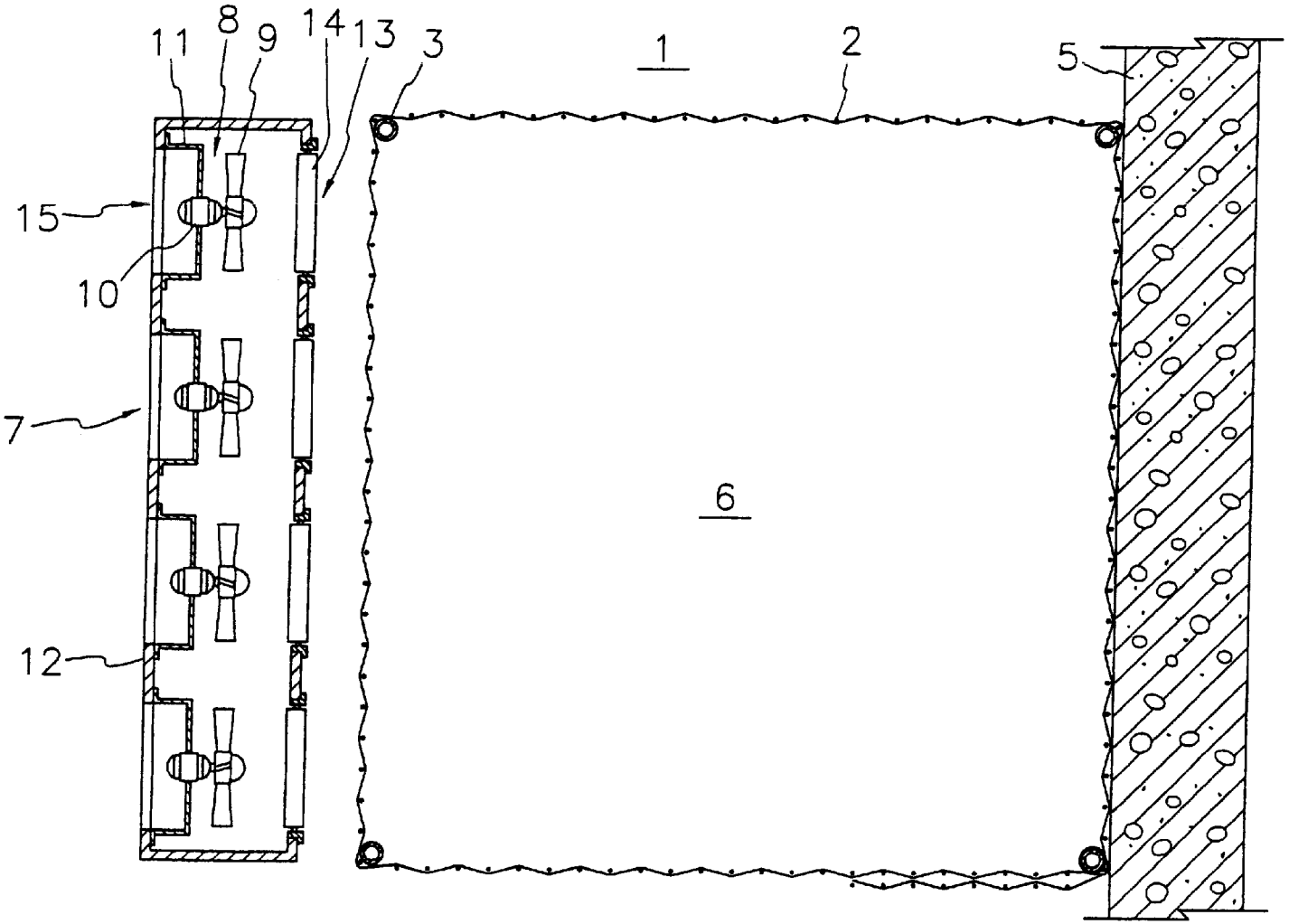
FIG. 3 is a sectional view as seen in an arrow direction II—II in FIG. 1.

An amusement system 1 as shown in FIGS. 1 to 3 includes four support posts 3 standing upright on a floor surface 6, a mesh partition member 2 as the air permeable member spread over the support posts 3, balloons retained in a space defined by the partition member 2, and air supply means 7 provided adjacent a lower portion of the partition member outside the space.

The partition member 2 is spread over and stretched between the support posts 3 as covering all the side faces and top face of the space which has a rectangular column shape defined by the four support posts 3. Side edge portions of the partition member 2 overlap at a position A, so that a player can come into and out of the space through an opening formed by drawing aside the overlapping portions of the partition member 2 at the position A. The mesh partition member 2 is composed, for example, of natural fibers such as of a resin (e.g., rubber) or a metal, synthetic fibers or metal filaments, or composed of ropes or belts of any of these fibers and filaments.

As shown in FIGS. 2 and 3, the air supply means 7 includes air supply mechanisms 8 for generating a constant air stream, and a housing 12 accommodating therein the air supply mechanisms 8. The air supply mechanisms 8 each include an electric motor 10, a rotary fan 9 provided about a rotation axis of the electric motor 10, and a bracket 11 supporting the electric motor 10 on an interior surface of the housing 12. The housing 12 has air outlets 13 provided in a face thereof opposed to the partition member 2, and air inlets 15 provided in an opposite face thereof. The electric motors 10 are driven to rotate the rotary blades 9, whereby air is drawn into the housing 12 through the air inlets 15 and air streams are caused to flow out at a predetermined speed through the air outlets 13. Grates 16 for preventing a person from inserting his finger or the like are fitted in the respective air inlets 15, and louvers 14 for changing the flow direction of the air streams generated by the rotary fans 9 are provided in the respective air outlets 13. The louvers 14 extend horizontally and are each rotatable about a horizontal axis thereof as shown in FIGS. 2 and 3.

The shape of the balloons 4 is not limited to a spherical shape as shown in FIG. 1, but may be of any of other various shapes. The balloons may have various colors, or each be imparted with a plurality of colors to be colorful. Examples of a gas to be charged into the balloons 4 include helium and air which are usually employed. The gas to be employed in this embodiment preferably permits the balloons 4 to have such a specific gravity that the balloons 4 naturally fall in a windless state.

In this embodiment, a side face of the partition member 2 opposite from the side thereof provided with the air supply means 7 contacts an air impermeable wall surface 5 of a building as shown in FIG. 1.

In accordance with the amusement system 1, the electric motors 10 of the air supply means 7 are driven to rotate the rotary fans 9, whereby air is drawn into the housing 12 through the air inlets 15 and air streams are caused to flow out at a predetermined speed through the air outlets 13. As shown in FIG. 2, the air streams thus flowing out pass through the mesh partition member 2 into the space to flow along the floor surface 6, and then pass through the opposite side face of the partition member 2 to reach the wall surface 5. The air streams having reached the wall surface 5 hit against the wall surface 5 to be deflected along the wall surface 5. Thus, the air streams mostly flow up vertically to form upward air streams.

The balloons 4 retained in the space are stirred by the air streams thereby to float and swirl. That is, the balloons 4 which naturally fall onto the bottom of the space in a windless state sink onto the bottom of the space, and are moved toward the wall surface 5 by the air streams flowing out through the air outlets 13 of the air supply means 7 along the floor surface 6. The balloons 4 carried into the vicinity of the wall surface 5 are moved upward along the wall surface 5 in the space by the air streams (upward air streams) deflected by the wall surface 5. The balloons 4 carried to the top of the space hit against the top face of the partition member 2 in the space thereby to be brought out of the upward air streams. Finally, the balloons naturally fall onto the bottom of the space by gravity. This process sequence is repeated, whereby the balloons float and swirl.

Players play in various ways within the space in which the balloons are thus floating and swirling. For example, infant players play tag with their sight being obstructed by the balloons 4. Adult players walk into the space through an entrance to look for an exit thereby to enjoy feeling as if they were in a labyrinth. Further, players simply enjoy catching the floating balloons 4.

What happens within the space can be observed from the outside through the mesh partition member 2, so that observers of the players can keep watch on the players from the outside to see their states and plays. In this embodiment, the air supply mechanisms 8 are accommodated in the housing 12, so that the observers can step onto the housing 12. Therefore, the observers can observe or watch the infant players who are playing in the space from the outside while sitting on the housing 12 without physical fatigue. Further, both the players and the observers can visually enjoy with the colorful balloons retained in the space.

Since the air streams flowing along the bottom of the space hit against the wall surface 5 once to flow upward, reduction in the kinetic energy of the air streams is suppressed, and the speed of the upward air streams is properly maintained.

Since the air supply mechanisms 8 of the air supply means 7 are accommodated in the housing 12 and the air supply means 7 is provided adjacent the bottom of the space, the provision of the air supply means 7 is very easily and readily achieved with no need for any special structure. In the amusement system 1, the support posts 3 merely serve to support the mesh partition member 2 and, therefore, may have a lower strength and a lower weight. Accordingly, the amusement system 1 is easy to transport and easy and convenient to assemble. Further, easy transportation of the air supply means 7 may be ensured by providing casters (wheels) on an under face of the housing 12.

The louvers 14 provided in the air outlets 13 of the housing 12 are adapted to change the flow directions of the air streams supplied from the air supply mechanisms 8, so that the flow direction of the air streams in the space can be adjusted. This optimizes the floating state of the balloons in the space.

Figure 4:
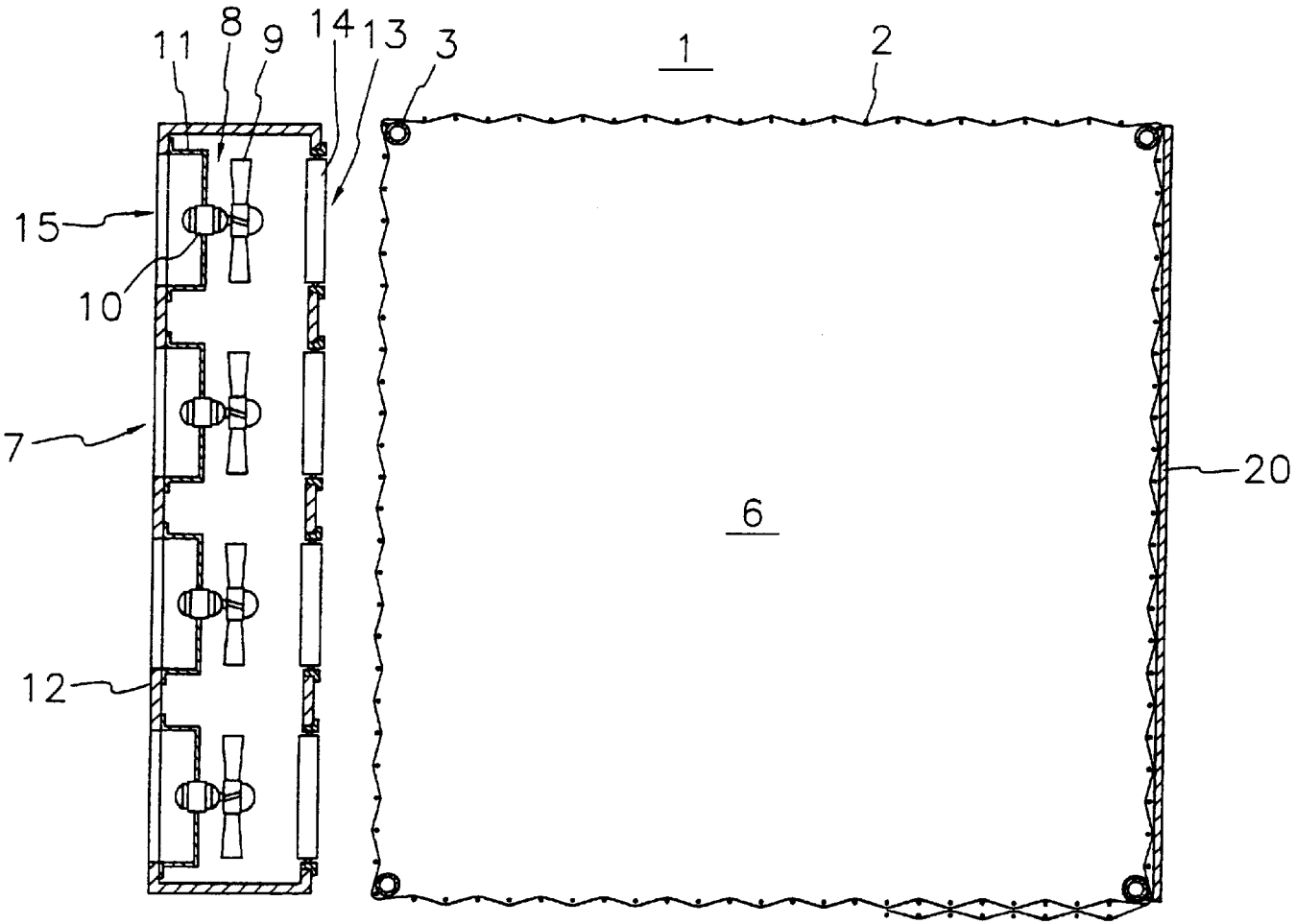
FIG. 4 is a sectional view illustrating another preferred amusement system according to the invention.

In this embodiment, the amusement system 1 is installed in such a manner that one side face of the space contacts the wall surface 5 of the building and the air supply means 7 is provided opposite from the wall surface 5. Alternatively, an air impermeable member 20 may be provided on an outer surface of the side face of the partition member 2 opposite from the air supply means 7 as shown in FIG. 4, or an air impermeable member may be provided as a part of the side face of the partition member 2 opposite from the air supply means 7 so as to be opposed to the air supply means 7. In an extreme case, a mesh member may be provided as a part of the side face of the partition member 2 adjacent to the air supply means 7 so as to be opposed to the air supply means 7 with the other part of the partition member 2 being constituted by an air impermeable member. With this arrangement, the air streams supplied from the air supply means 7 flow along the bottom of the space and then hit against the air impermeable member 20 as in the aforesaid amusement system 1. The air streams are deflected by the air impermeable member 20 thereby to flow upward. The upward air streams cause the balloons 4 retained in the space to float and swirl. The air impermeable member have the function of limiting air passage to some extent, and examples thereof include plate members such as a glass plate and an acryl plate, resin sheets such as a nylon sheet and a vinyl sheet, woven fabrics and knitted fabrics.

Figure 5:
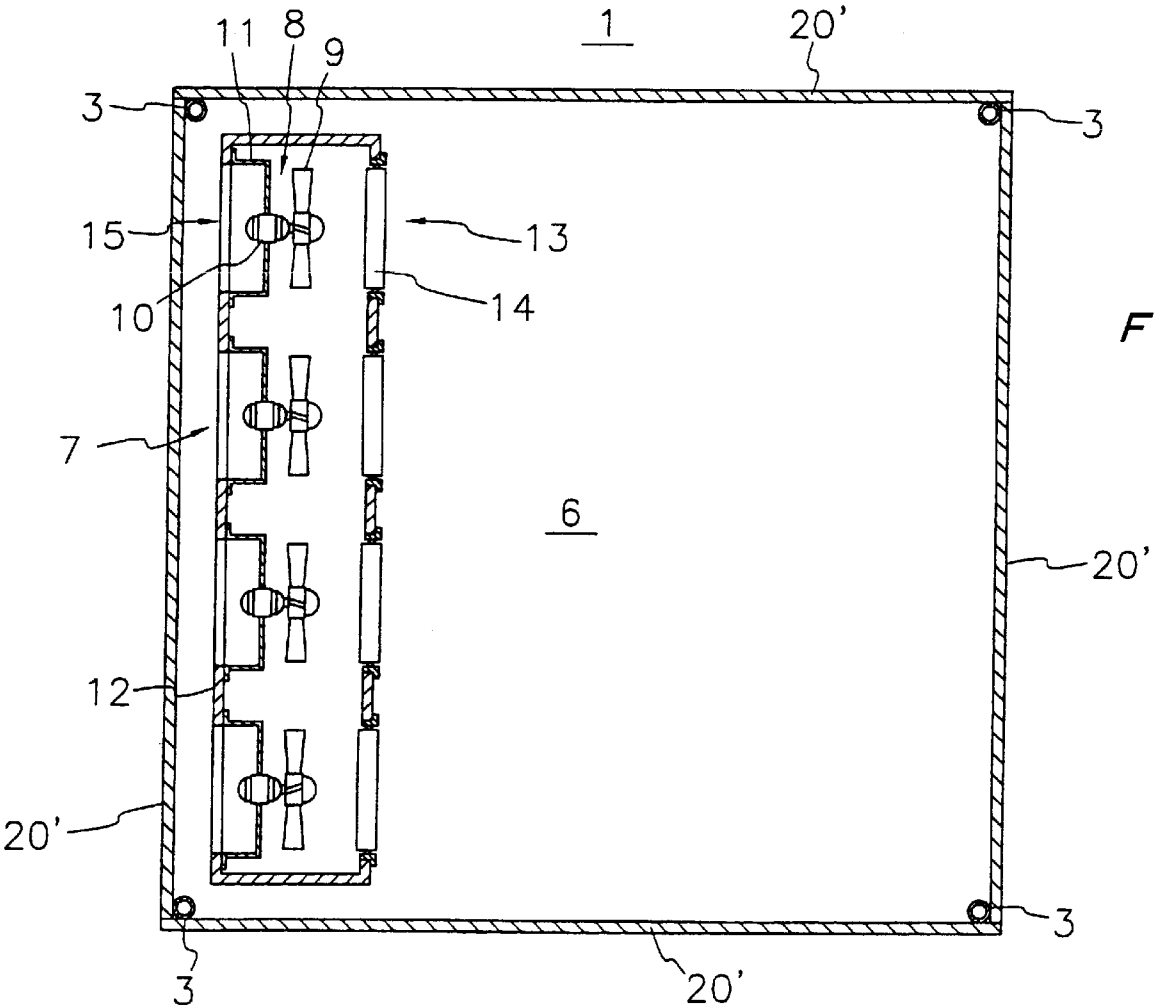
FIG. 5 is a sectional view illustrating further another preferred amusement system according to the invention.

As shown in FIG. 5, the amusement system 1 according to the aforesaid embodiment may be constructed such that the partition member 2 is entirely constituted by an air impermeable member 20' and the air supply means 7 is provided within the space. With this arrangement, players can enjoy stepping on and off the housing 12 with increasing pleasure. In this case, it is merely necessary that at least the part of the side face of the partition member 2 opposite from the air supply means 7 is constituted by an air impermeable member and, therefore, the other part of the partition member 2 may be constituted by a mesh member (air permeable member)

Figure 6:
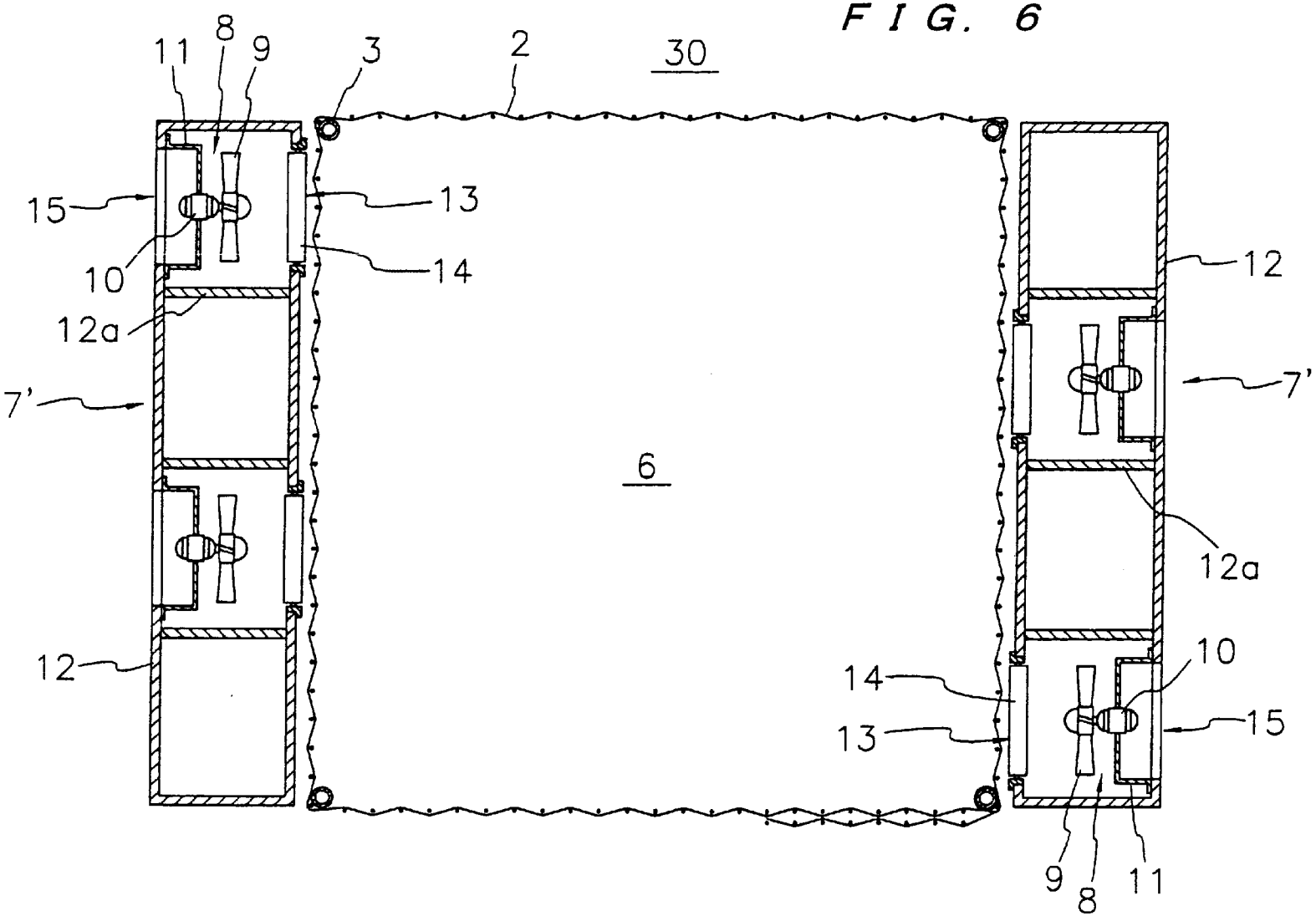
FIG. 6 is a sectional view illustrating still another preferred amusement system according to the invention.

The air supply means 7 may be constructed as shown in FIG. 6. FIG. 6 is a sectional view illustrating the amusement system as seen in the same direction as the arrow direction II—II in FIG. 1. As shown, an amusement system 30 has substantially the same construction as the amusement system 1, except that a pair of air supply means 7' having a construction slightly different from the construction of the air supply means 7 shown in FIGS. 1 to 3 are provided on opposite sides of the space defined by the partition member 2. As shown in FIG. 6, the air supply means 7' each have a housing 12 like the air supply means 7 shown in FIG. 1. The housing 12 is partitioned into a plurality of chambers by partition plates 12*a*, and air supply mechanisms 8 are provided in every second chamber. The chambers of the housing 12 in which the air supply mechanisms 8 are provided each have an air inlet 15 and an air outlet 13. As shown, the air supply mechanisms 8 of one of the air supply means 7' are opposed to a side face of the other air supply means 7', and arranged in a staggered relation with respect to the air supply mechanisms 8 of the other air supply means 7'.

In the amusement system 30, air streams supplied from the respective air supply mechanisms 8 of the air supply means 7' flow along the bottom of the space and hit against side walls of the housings 12 of the opposed air supply means 7'. The air streams are deflected by the side walls thereby to flow upward. The upward air streams cause the balloons 4 retained in the space to float and swirl. The other action and effect provided by this amusement system are the same as those provided by the amusement system 1. The amusement system 30 may be constructed such that the air supply means 7' are disposed within the space. More specifically, both of the air supply means 7' maybe disposed within the space. Alternatively, one of the air supply means 7' may be disposed inside the space with the other air supply means 7' disposed outside the space. It is merely necessary that at least a part of the partition member 2 opposed to the air outlets 13 of the air supply means 7 disposed outside the space is constituted by the mesh member and, therefore, the other part of the partition member 2 may be constituted by an air impermeable member.

Figure 7:
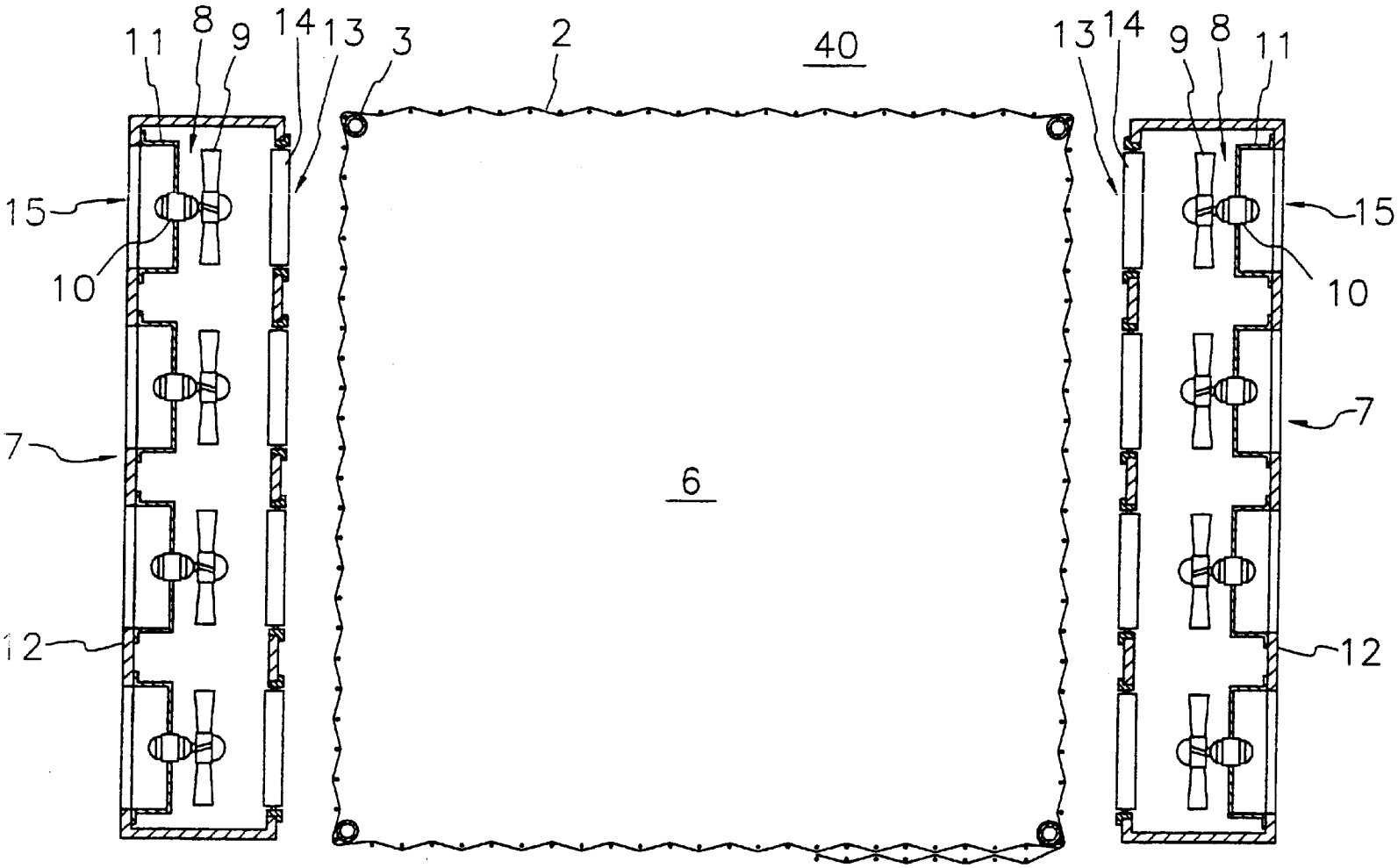
FIG. 7 is a sectional view illustrating a modification of the amusement system shown in FIG. 6.

The air supply means 7 may be constructed as shown in FIG. 7. FIG. 7 is a sectional view illustrating an amusement system as seen in the same direction as the arrow direction II—II in FIG. 1. As shown, the amusement system 40 has substantially the same construction as the amusement system 1, except that a pair of air supply means 7 are provided on opposite sides of the space defined by the partition member 2. As shown in FIG. 7, the air supply mechanisms 8 of the respective air supply means 7 are provided in an opposed relation in the amusement system 40. In the amusement system 40, air streams supplied from the opposed air supply mechanisms 8 flow along the bottom of the space and collide with each other in a middle portion of the space. Thus, the air streams are deflected thereby to flow upward in the space. The upward air streams cause the balloons 4 retained in the space to float and swirl. Since the air streams flow in various ways after having collided with each other, the balloons 4 retained in the space are stirred by the air streams thus flowing in various ways thereby to float and swirl in various ways.

Figure 8:
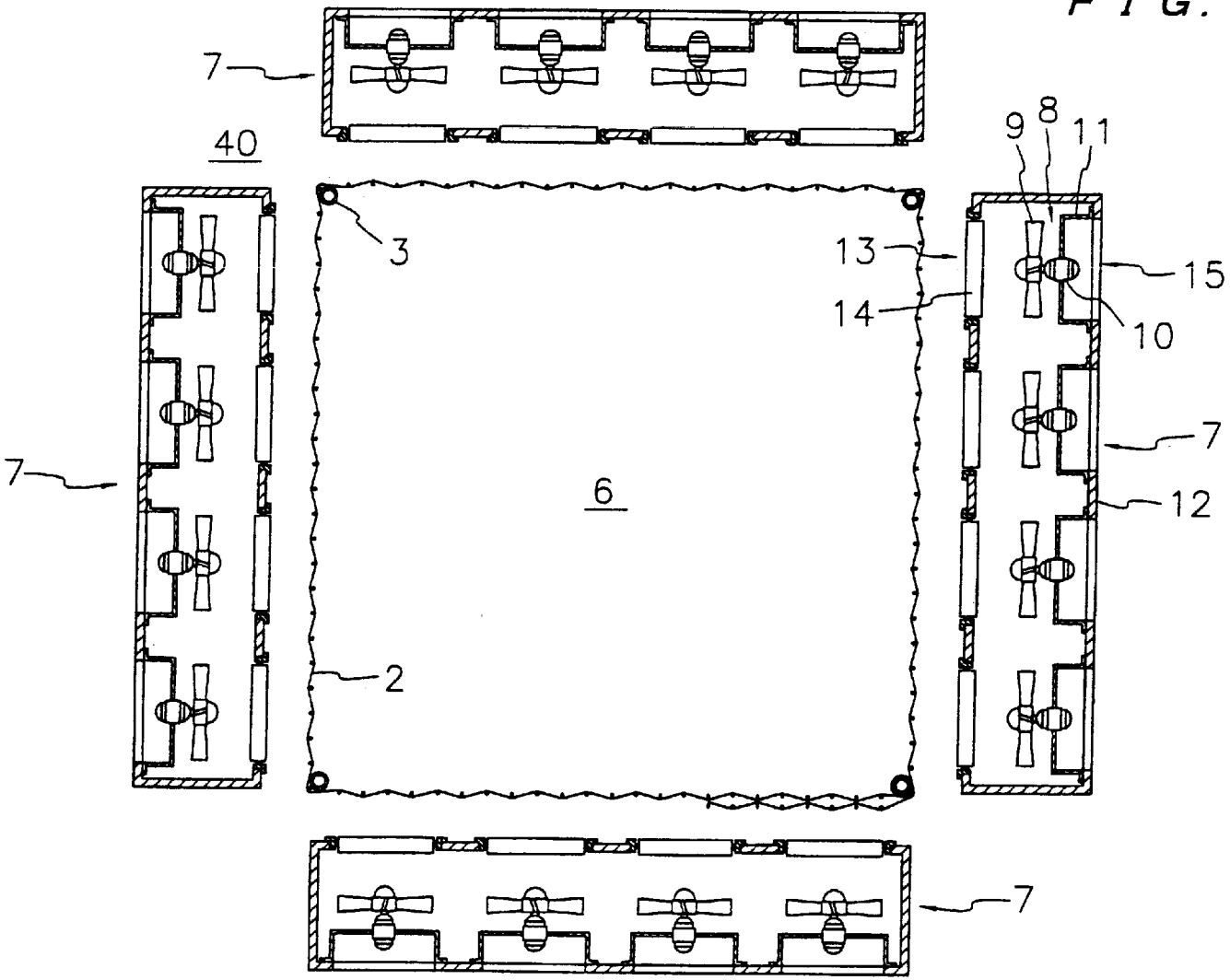
FIG. 8 is a sectional view illustrating another modification of the amusement system shown in FIG. 6.

As shown in FIG. 8, air supply means 7 may be disposed along the periphery (four side faces) of the space. With this arrangement, air streams flowing in four directions collide with each other in a central portion of the space thereby to flow vigorously in various ways. The air streams cause the balloons 4 retained in the space to float and swirl in further various ways. The other action and effect provided by this amusement system are the same as those provided by the aforesaid amusement system 1.

In this case, the air supply means 7 may be provided within the space. More specifically, all the air supply means 7 may be disposed inside the space. Alternatively, some of the air supply means 7 may be disposed inside the space with the other air supply means 7 disposed outside the space. It is merely necessary that at least a part of the partition member 2 opposed to air outlets 13 of the air supply means 7 disposed outside the space is constituted by a mesh member and, therefore, the other part of the partition member 2 may be constituted by the air impermeable material.

Figure 9:
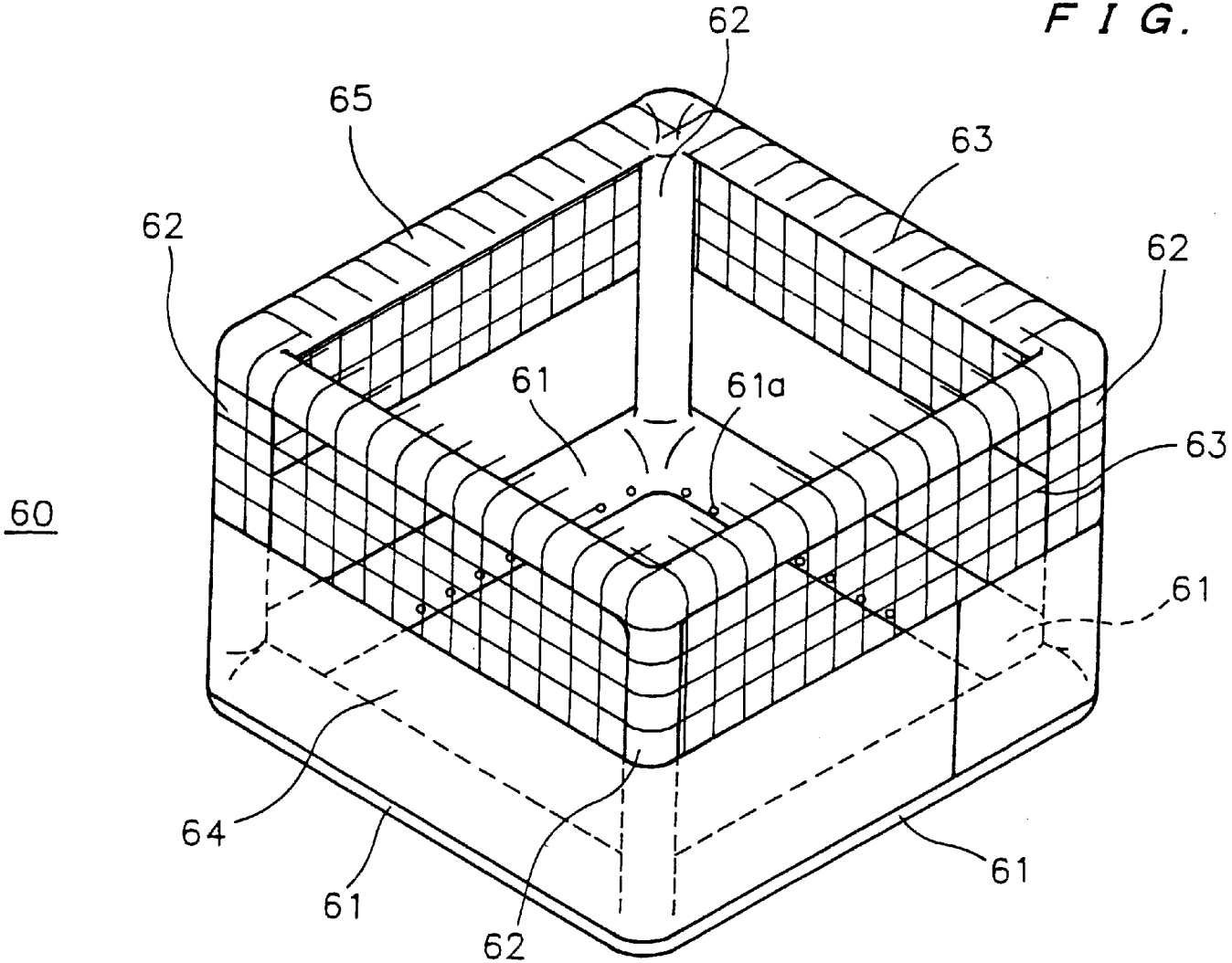
FIG. 9 is a perspective view illustrating further another preferred amusement system according to the invention.

The amusement system according to the present invention may be constructed as shown in FIG. 9. As shown, an amusement system 60 includes a base member 61 of a rectangular ring shape, support posts 62 provided on respective corners of the base member 61, and a top member 65 having a rectangular ring shape conformal to the base member 61 and connected to top ends of the respective support posts 62. The base member 61, the support posts 62 and the top member 65 are hollow members which are composed of a generally resilient sheet, and the hollow inside portions thereof communicate with each other. The base member 61, the support members 62 and the top member 65 are supplied with compressed air from compressed air supply means (not shown) such as a compressor or a blower so as to be expanded into the illustrated shape by the compressed air. The base member 61 has air outlets 61*a* provided at predetermined intervals along an inner periphery thereof, so that the compressed air supplied into the base member 61 is discharged from the air outlets 61*a*. The base member 61 and the compressed air supply means (not shown) serve as the air supply means.

A top face and upper portions of side faces of a space defined by the base member 61, the support posts 62 and the top member 65,are covered with a mesh member 63, and lower portions of the side faces of the space are covered with a sheet member 64. Thus, the space is enclosed by the base member 61, the support posts 62, the top member 65, the mesh member 63 and the sheet member 64. A plurality of balloons are retained in the space. In FIG. 9, a portion of the mesh member 63 covering the top face of the space is not illustrated for convenience.

In the amusement system 60 having the aforesaid construction, the compressed air supplied into the base member 61 is discharged into the space from the respective air outlets 61*a* to form air streams, which flow along a bottom surface of the space and collide with each other in a central portion of the space. Thus, the air streams are deflected thereby to flow upward in the space. The upward air streams cause the balloons retained in the space to float and swirl. As in the aforesaid cases, the collision causes the air streams to flow in various ways, so that the balloons retained in the space are stirred by the air streams flowing in various ways thereby to float and swirl in various ways. The base member 61, the top member 65 and the support posts 62 each having resiliency are safe for players. Where a bottom portion of the space is constructed in the same manner as the base member 61, the top member 65 and the support posts 62, the players can get amusement with a floating feeling.

Although the lower portions of the side faces of the space are defined by the air impermeable sheet member 64 in this case, an air permeable mesh member 63 may be employed instead of the sheet member 64 for defining the lower portions. On the contrary, a sheet member 64 may be employed instead of the mesh member 63 for defining the space. In this case, at least one air vent is preferably provided in the top face or side faces of the space for discharging the air from the inside to the outside of the space, or a part of the partition member defining the top face or a side face of the space is constituted by an air permeable member.

Although the air outlets 61*a* are provided along the inner periphery of the base member 61 in this case, the positions of the air outlets are not limited thereto. The air outlets 61*a* may be provide in the inner periphery of the base member 61 along at least one edge thereof. Where the air outlets 61*a* are provided only along the one edge, a lower portion of a side face of the space opposite from the edge of the base member provided with the air outlets 61*a* is preferably constituted by a sheet member 64. Thus, the air streams discharged from the air outlets 61*a* flow along the bottom of the space, and then hit against the sheet member 64 thereby to be deflected. The air streams flow up generally vertically along the sheet member 64, so that the balloons retained in the space are stirred by the upward air streams thereby to float and swirl.

Although the compressed air is supplied to the air outlets 61*a* through the same flow path as supplied to the base member 61, the top member 65 and the support posts 62 for expansion thereof in this case, the arrangement for the supply of the compressed air is not limited thereto. Different flow paths may be provided to supply the compressed air to the base member 61, the top member 65 and the support posts 62 for expansion thereof and to supply the compressed air to the air outlets 61*a* by partitioning the inside of the base member 61. This arrangement prevents reduction of the internal pressure of the base member 61, the top member 65 and the support members 62 which may otherwise occur due to discharge of the compressed air through the air outlets 61*a*, so that the base member 61, the top member 65 and the support members 62 can maintain their shapes shown in FIG. 9.

While the specific amusement systems according to the present invention have thus been described in detail, specific embodiments of the invention will not be limited to these amusement systems. In the amusement systems shown in FIGS. 1 to 9, the space defined by the partition member 2, 63 is of a rectangular column shape. The shape of the space is not limited thereto, but may be any of other polygonal column shapes, cylindrical shapes, oval column shapes, and dome shapes with a polygonal, round or oval bottom face. In this case, the housing 12 of the air supply means 7, 7' preferably has a shape conforming to the shape of the outer periphery of the space. In any of the amusement systems shown in FIGS. 1 to 8, a dome-shaped space can easily be formed by employing flexible bars for formation of a frame. The bars are curved into an arcuate form, on which the partition member 2 is supported.

Although the mesh member is employed as the air permeable member, the material for the air permeable member is not limited thereto. Any materials that permit air (gas) to pass therethrough from one side to the other side thereof, for example, a grid-pattern material, may be employed.

The air supply means 7, 7' may include a housing 12 having air outlets 13, and compressed air supply means such as a compressor or a blower for supplying compressed air into the housing 12, and be adapted to discharge the compressed air supplied to the housing 12 from the compressed air supply means into the space. In this case, the air supply means may include a switching mechanism for opening and closing the air outlets 13. The air supply mechanisms 8 are not limited to those, described above, but may be any mechanism which is capable of generating constant air streams, for example, a rotor type air supply mechanism which includes a cylindrical member and a plurality of blades provided on an outer circumference of the cylindrical member as extending axially thereof.

In the aforesaid cases, the louvers 14 are provided horizontally, but may be provided vertically so as to be rotatable in opposite directions about vertical axes thereof. Alternatively, both the horizontal louvers and the vertical louvers may be provided. Further, driving means may be provided for periodically rotating the louvers 14 in opposite directions. Thus, the flow directions of the air streams can automatically and periodically be varied so as to cause the air streams to flow in various ways within the space.

The amusement systems shown in FIGS. 1 to 8 may each be constructed such that the support posts and the bottom and peripheral portion of the space are constituted by air bags of a polyvinyl chloride sheet filled with air as in the amusement system shown in FIG. 9. With this arrangement, the amusement systems are imparted with cushioning property and is hence safe for players. In addition, the players can get amusement with a floating feeling.

Figure 10:
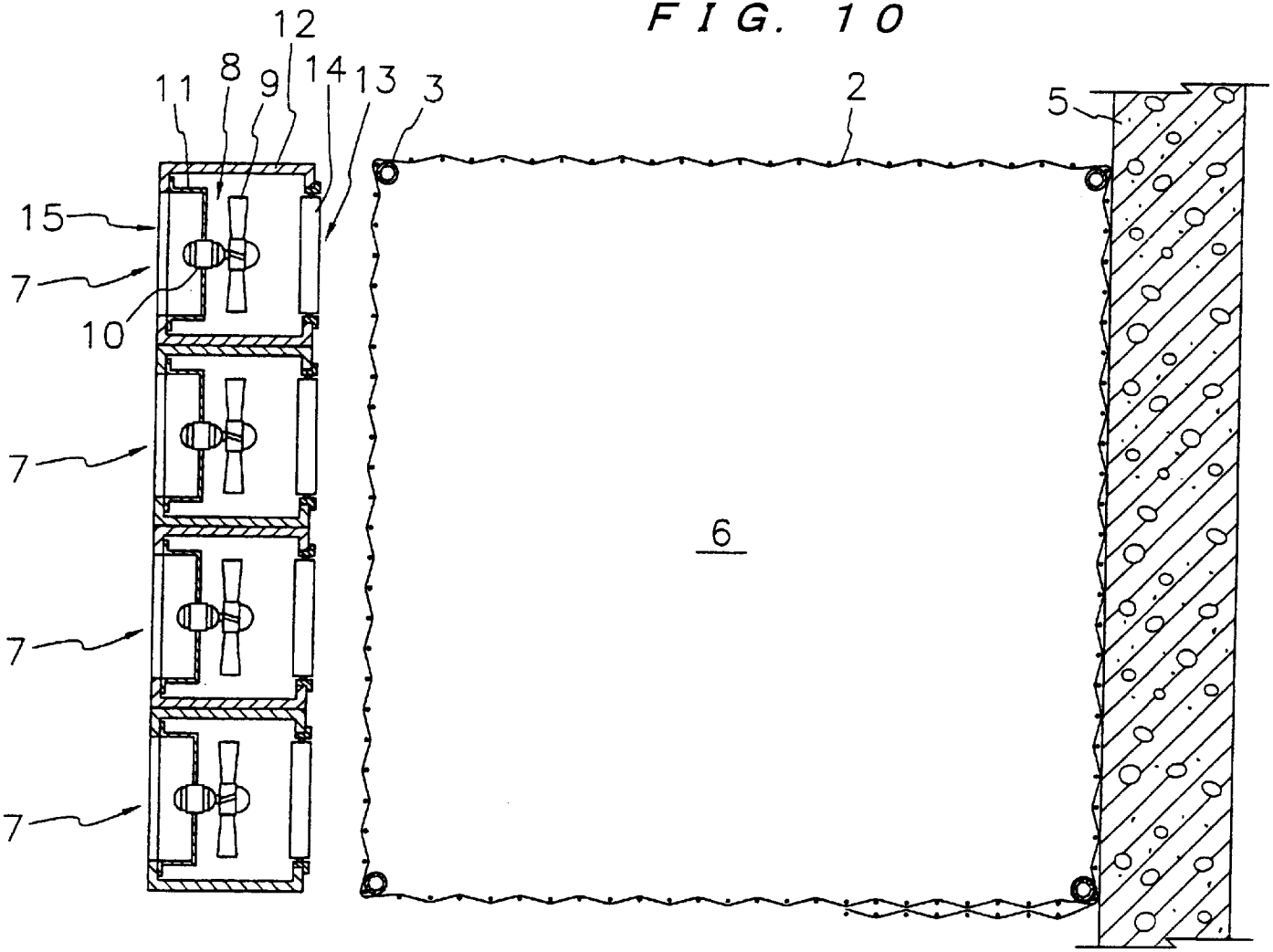
FIG. 10 is a sectional view illustrating a modification of the amusement system shown in FIGS. 1 to 3.

As shown in FIG. 10, the air supply means 7 including the plurality of air supply mechanisms 8 may be divided into separate cells for the respective air supply mechanisms 8. With this arrangement, the cells of the air supply means 7 each have a smaller size thereby to be easier to transport. FIG. 10 illustrates a modification of the amusement system 1 shown in FIGS. 1 to 3, as a typical example, wherein the air supply means 7 is divided into separate cells.

Figure 11:
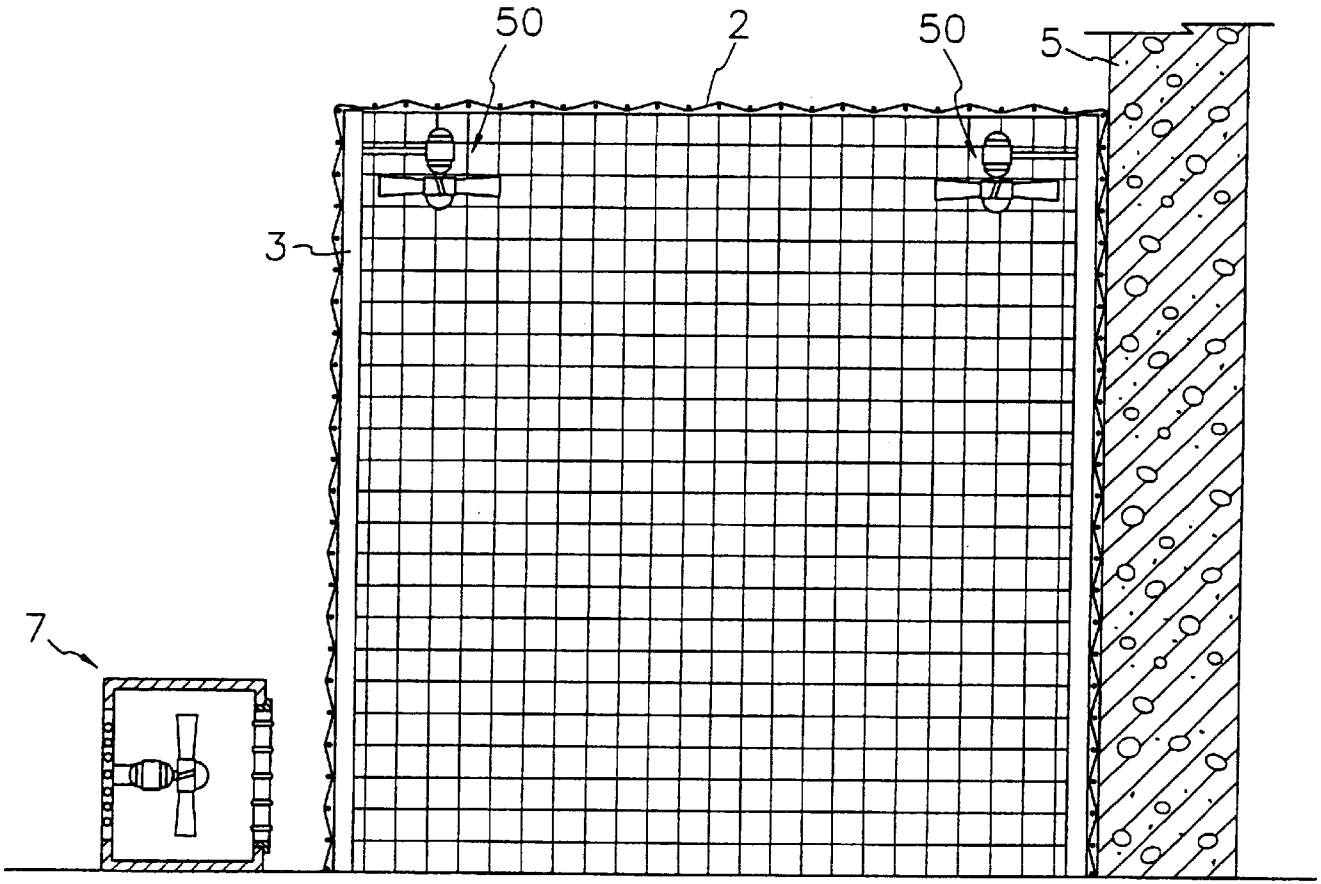
FIG. 11 is a sectional view illustrating another modification of the amusement system shown in FIGS. 1 to 3.

As shown in FIG. 11, second air supply means 50 may be provided in an upper portion of the space for generating air streams flowing down from the upper portion to the bottom portion of the space. With this arrangement, the air streams generated by the air supply means 7 and the air streams generated by the second air supply means 50 are commingled with each other, so that complicatedly variable air streams are generated. Such air streams cause the balloons retained in the space to float and swirl in a complicatedly variable manner. FIG. 11 illustrates a modification of the amusement system 1 shown in FIGS. 1 to 3, as a typical example, wherein the second air supply means 50 is provided.

Figure 12:
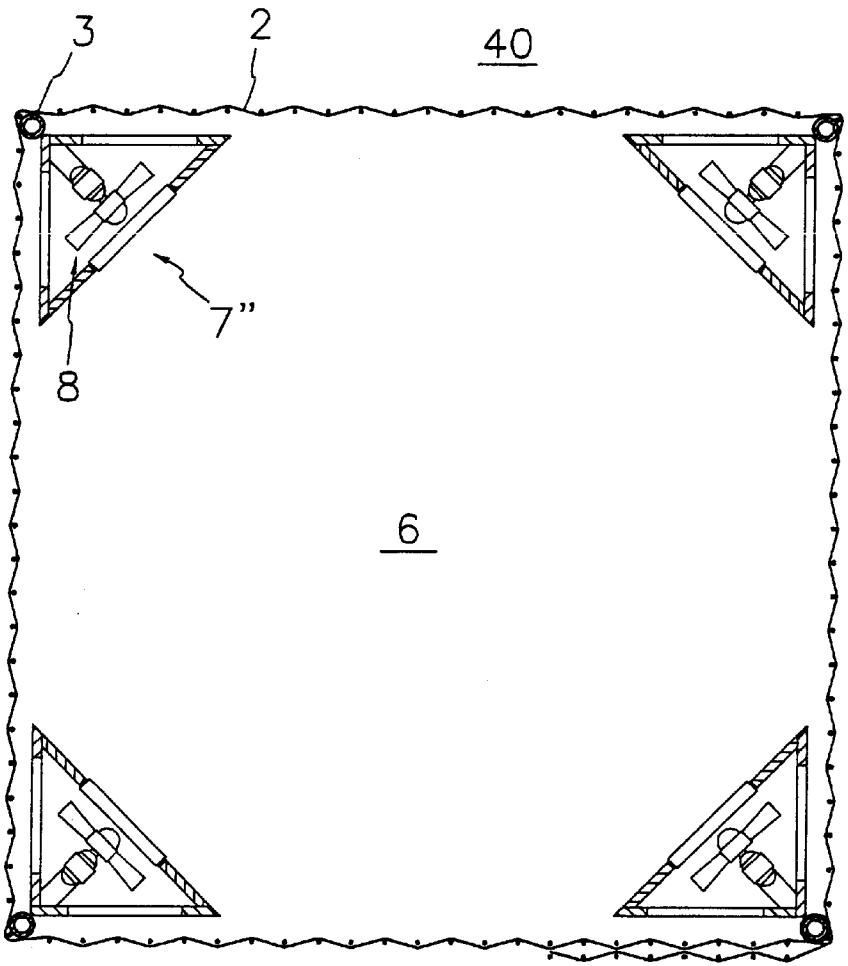
FIG. 12 is a sectional view illustrating a modification of the amusement system shown in FIG. 8.

As shown in FIG. 12, the air supply means 7" may be located in corners of the space defined by the partition member 2 in the amusement systems shown in FIG. 1 to 8. FIG. 12 illustrates a modification of the amusement system 40 shown in FIG. 8 as a typical example.

Figure 13:
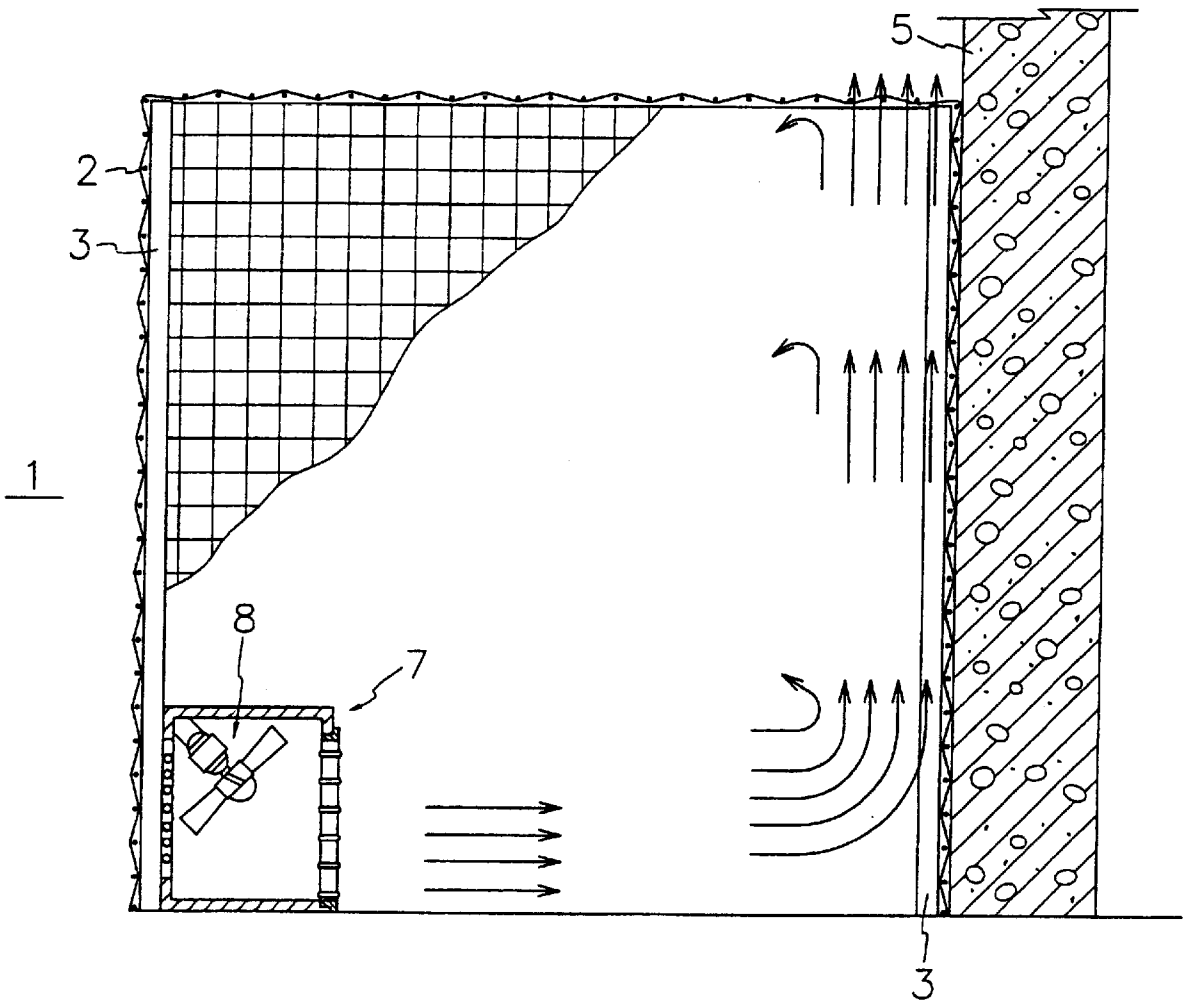
FIG. 13 is a sectional view illustrating further another modification of the amusement system shown in FIGS. 1 to 3.

As shown in FIG. 13, the air supply mechanisms 8 may be inclined downward to such an extent that the strength of the supplied air streams can properly be maintain in the amusement systems shown in FIGS. 1 to 8, 10 and 12. FIG. 13 illustrates a modification of the amusement system 1 shown in FIG. 2 as a typical example.

INDUSTRIAL APPLICABILITY

As described above, the amusement system according to the present invention is advantageously installed in a resort or amusement place such as an amusement park or an ordinary park, a department store or a shopping center, where infants are likely to gather.

What is claimed is:

1. A facility for playing comprising:

a plurality of balloons retained in a space defined by a partition by a partition member; and at least one air supply means for causing air to flow whithin the space, wherein the air supply means is provided adjacent the bottom of the space inside the space, whereby the air supply means generates an air stream which flows along the bottom of the space, so that the balloons retained in the space are stirred by the air steam generated by the air supply means thereby to float and swirl, further comprising an air impermeable member provided downstream of the air supply means separately from the partition member, whereby the air stream generated by air supply means is deflected by the air impermeable member provided separately from the partition members, so that the balloons retained in the space are stirred by the air steam from the air from the supply means deflected by the air impermeable member thereby to float and swirl.

2. A facility for playing comprising:

a plurality of balloons retained in a space defined by a partition member; and at least one air supply means for causing air to flow with in the space, wherein the air supply means is provided adjacent the bottom of the space outside the space, said partition member comprises an air permeable member, whereby the air supply means generated an air stream which flows along the bottom of the space, so that balloons retailed in the space are stirred by the air stream generated by the air supply means thereby to float and swirl.

3. A facility for playing as set forth in claim 2, said partition member having an air impermeable member wherein the air impermeable member constitutes at least a portion of the partition member located in a spaced and opposed relation with respect to the air supply means, whereby the air stream generated by the air supply means is deflected by the air impermeable member opposed to the air supply means so that the balloons retained in the space are stirred by the air stream from the air supply means and the air stream deflected by the air impermeable member thereby to float and swirl.

4. A facility for playing as set forth in claim 2, further comprising an air impermeable member provided downstream of the air supply means separately from the partition member, whereby the air stream generated by the air supply means is deflected by the air impermeable member provide separately from the partition member, so that the balloons retained in the space are stirred by the steam from the air supply means and the air stream deflected by the second air impermeable member thereby to float and swirl.

5. A facility for playing as set forth in claim 2, where the air supply means includes at least one pair of air supply means are disposed in such a relation that air supply directions there are crosswise to each other, whereby the air steams supplied from the air supply means collide with each in the space to swirl in the space, so that the balloons retained in the space are stirred by the air streams from the air steams from the air supply means and the swirling stream thereby to float and swirl.

6. A facility for playing as set forth in claim 2 to 5, wherein the air supply means includes an air supply mechanism for supplying energized gas in a predetermined direction, and a housing accommodating there the air supply mechanism and having an air oulet and an air oulet, whereby a constant air steam is supplied throught the air oulet.

7. A facility for playing as set forth in claim 6, wherein the air outlet is provided with louvers for changing a flow direction of the air steam supplied from the air supply mechanism.

8. A facility for playing as set forth in claim 7, wherein driver means for driving the louvers is provided.

* * * * *